United States Patent [19]

Allen et al.

[11] Patent Number: 4,811,778

[45] Date of Patent: Mar. 14, 1989

[54] METHOD OF MANUFACTURING A METAL ARTICLE BY THE LOST WAX CASTING PROCESS

[75] Inventors: David J. Allen, Derby; Joseph Martin; Peter E. Rose, both of Staffordshire; John Terry, Derby, all of England

[73] Assignee: Rolls-Royce PLC, London, England

[21] Appl. No.: 177,138

[22] Filed: Apr. 4, 1988

[30] Foreign Application Priority Data

Jun. 3, 1987 [GB] United Kingdom ..... 8712952

[51] Int. Cl.[4] ..... B22C 9/02

[52] U.S. Cl. ..... 164/516; 29/156.8 B; 29/156.8 H; 29/424; 29/527.5; 164/35; 164/397; 164/399

[58] Field of Search ..... 29/156.8 H, 156.8 B, 29/424, 527.5, 527.1, 530; 164/34, 35, 36, 397, 398, 399, 340, 137, 516, 121, 122

[56] References Cited

U.S. PATENT DOCUMENTS

| | | | |
|---|---|---|---|
| 3,401,738 | 9/1968 | Parilli | 164/399 |
| 3,596,703 | 8/1971 | Bishop et al. | 29/156.8 H |
| 3,662,816 | 5/1972 | Bishop et al. | 164/399 |
| 4,068,702 | 1/1978 | Herold | 164/122.1 |
| 4,078,598 | 3/1978 | Kelso et al. | 164/122.1 |
| 4,283,835 | 8/1981 | Obrochta et al. | 164/45 |
| 4,384,607 | 5/1983 | Wood et al. | 29/156.8 H |
| 4,417,381 | 11/1983 | Higginbotham | 29/156.8 H |
| 4,596,281 | 6/1986 | Bishop | 164/122.1 |
| 4,732,204 | 3/1988 | Tabardin | 164/516 |

FOREIGN PATENT DOCUMENTS

| | | | |
|---|---|---|---|
| 0216953 | 10/1985 | Japan | 164/397 |
| 0074754 | 4/1986 | Japan | 164/35 |
| 1093385 | 5/1984 | U.S.S.R. | 164/516 |
| 2111881 | 7/1983 | United Kingdom | 164/398 |

*Primary Examiner*—Timothy V. Eley
*Assistant Examiner*—Irene Cuda
*Attorney, Agent, or Firm*—Cushman, Darby & Cushman

[57] ABSTRACT

The pins which are used for the support of a core in a lost wax casing process are provided with caps. The caps provide sufficient surface area for encapsulation by ceramic slurry. Heat loss from the metal melt via the pins is thus obviated along with undesirable grain nucleation.

2 Claims, 1 Drawing Sheet

METHOD OF MANUFACTURING A METAL ARTICLE BY THE LOST WAX CASTING PROCESS

This invention relates to a manufacturing method which involves the lost wax casting process.

The invention further relates to an article manufactured by a method which involves the lost wax casting process.

The lost wax casting process is well known in its use for the manufacturing of finished size, high precision articles, e.g. turbine blades for gas turbine engines. Some turbine blades are hollow so as to enable cooling air to be introduced internally when in situ. Such blades are produced by enveloping a ceramic core with wax, inserting platinum pins through the wax so that the inner ends of the pins abut the core and the outer ends of the pins protrude a short distance from the wax and then enveloping the wax and most of each pin in a ceramic slurry. The whole is heat soaked so that the slurry hardens and thus supports the pins and the wax melts and runs out, leaving the core held by the platinum pins in spaced relationship with the hardened slurry. The space is then filled with molten metal, to form a hollow article.

During the casting process that portion of each of the platinum pins which is covered by the molten metal diffuses into the molten metal so completely, as to effectively not generate any local alloys of blade metal and platinum. What has been discovered however, is that grain nucleation occurred at the sites of the pins. Where these methods of casting are employed to form blades which are known by persons skilled in the art as single crystal blades and directionally solidified blades, such an occurrance is not acceptable.

It has been found that the local nucleations were generated as a result of local heat loss from the melt via each pin. The pins however, were too small for slurry to adhere to their outer ends. Moreover the pins could not be enlarged because of the danger of creating an undesirable alloy with the melt.

The invention seeks to provide an improved method of manufacturing a cast article.

The invention further provides an article cast by the improved method.

According to the present invention, in the method of manufacturing a metal article which has a hollow therein by the lost wax process and wherein a hollow defining core is encased in wax and pins are inserted through the wax so that the inner end of each pin abuts the core and the outer end of each pin protrudes from the wax, the steps of fitting heat retaining caps on the outer end of each pin in spaced relationship with the encasing wax and encapsulating the whole in a ceramic slurry, drying the slurry, melting the encasing wax out of the hardened slurry and pouring molten metal into the resulting space.

Preferably the method comprises fitting wax caps to the outer ends of the pin,

The article may comprise a turbine blade suitable for use in a gas turbine engine.

Figure 1:
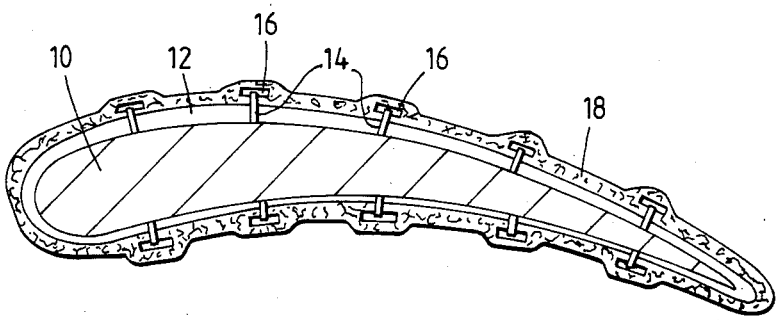
Figure 2:
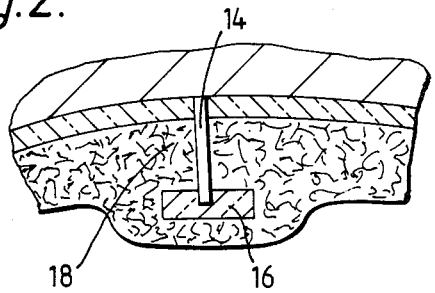

The invention will now be described by way of example and with reference to the accompanying drawings in which:

FIG. 1 is a diagrammatic cross-sectional view of an assembly in accordance with the present invention and FIG. 2 is an enlarged part view of FIG. 1.

Referring to FIG. 1, a ceramic core 10 is encased in wax 12. A number of platinum pins 14 are inserted through the wax 12 such that their inner ends abut the core 10. The length of each pin 14 is sufficient for it to protrude beyond the outer surface of the wax 12.

A wax cap 16 is pressed onto the outer end of each pin 14 and each cap is proportioned so as to have a surface area which is considerably greater than the cross sectional area of the associated pin 14. Further, each pin 14 projects from the wax 12 a sufficient distance as to ensure that its cap 16 when attached thereto, is spaced from the wax 12, for reasons which are explained hereinafter.

After attaching the caps 16 to the pins 14, the whole assembly is encased in a ceramic slurry 18. The magnitude of the space between each cap 16 and the wax 12 is such that the slurry 18 can easily enter and so completely bridge it. This is more clearly seen in FIG. 2 to which reference is now made. Each cap 16 and the outer end of its respective pin 14 is thus completely encapsulated in the ceramic slurry 18. The slurry 18 is then dried and the wax melted from within in a known manner. The wax caps 16 however, do not run from their cavities in the dried slurry. Instead, during the metal pouring step which follows wax melting, the now melted caps 16 retain heat by virtue of the encapsulating ceramic acting as a barrier against heat loss. This in turn obviates grain nucleation in the casting, in the vicinity of the pins 14.

Whilst the material of the caps of the specific example 15 is wax, other material may be used provided that undesirable alloying with the melt is avoided.

We claim:

1. The method of manufacturing a metal article having a hollow therein by the lost wax process and comprising the steps of encasing a core in wax, inserting pins through the wax so that the inner end of each pin abuts the core and the outer end of each pen protrudes from said wax, the improvement comprising attaching heat-retaining caps on the outer ends of said pins in spaced relationship from the wax, encapsulating the wax, the pins and the core encased within the wax in a ceramic slurry, drying the slurry, thereafter melting the encasing wax and removing it from within the hardened slurry, and finally, pouring molten metal into the space defined by the harden slurry.

2. The method of claim 1 wherein the step of fitting heat retaining caps to the outer ends of said pins comprises fitting wax caps thereon.

* * * * *